United States Patent [19]

Imanaka et al.

[11] Patent Number: 4,540,270

[45] Date of Patent: Sep. 10, 1985

[54] ELECTROPHOTOGRAPHIC COPYING MACHINE WITH A PRE-COPY SYSTEM

[75] Inventors: Yoshiaki Imanaka, Nara; Hiroshi Kinashi, Uji, both of Japan

[73] Assignee: Sharp Kabushiki Kaisha, Osaka, Japan

[21] Appl. No.: 576,272

[22] Filed: Feb. 2, 1984

[30] Foreign Application Priority Data

Feb. 9, 1983 [JP] Japan ..... 58-21212

[51] Int. Cl.[3] ..... G03G 15/00; G03G 21/00

[52] U.S. Cl. ..... 355/3 R; 355/14 R; 355/14 C

[58] Field of Search ..... 355/3 R, 14 R, 14 C, 355/14 CU

[56] References Cited

U.S. PATENT DOCUMENTS

| | | | |
|---|---|---|---|
| 4,416,536 | 11/1983 | Itoh et al. | 355/3 R X |
| 4,429,986 | 2/1984 | Abe et al. | 355/14 R X |
| 4,436,408 | 3/1984 | Inuzuka et al. | 355/14 R |
| 4,442,505 | 5/1984 | Takano | 355/14 R X |
| 4,448,515 | 5/1984 | Ishikawa | 355/14 R |
| 4,451,136 | 5/1984 | Tanioka et al. | 355/14 R X |
| 4,464,044 | 8/1984 | Matsuyama | 355/3 R X |
| 4,465,360 | 8/1984 | Yamagishi et al. | 355/14 R |
| 4,470,692 | 9/1984 | Shimizu et al. | 355/14 R |

*Primary Examiner*—Laramie E. Askin
*Assistant Examiner*—Terry Flower
*Attorney, Agent, or Firm*—Birch, Stewart, Kolasch & Birch

[57] ABSTRACT

An electrophotographic copying machine is of the type which starts, in response to the actuation of a copy start switch, its copying operation after a pre-copy process is conducted to stabilize the property of a photoreceptor. The copying machine comprises a selection circuit and a timer. The selection circuit is operated to start the timer upon the termination of a previous copying operation. During a time as set for the timer, the pre-copy process is carried out following the termination of the previous copying operation. In response to the actuation of the copy start switch, the following copying operation is started just following the termination of the previous copying operation.

1 Claim, 4 Drawing Figures

ELECTROPHOTOGRAPHIC COPYING MACHINE WITH A PRE-COPY SYSTEM

BACKGROUND OF THE INVENTION

The present invention relates to an electrophotographic copying machine and, more particularly, to a circuit for initializing and stabilizing the property of a photoreceptor in an electrophotographic copying machine.

An electrophotographic copying machine produces a electrostatic latent image onto a photoreceptor corresponding to a pattern image on a document such as a manuscript or book to be copied. Toner particles are electrostatically adhered to the latent image, so that the image becomes visible as a toner image. The toner image on the photoreceptor is transferred onto a copy paper via a transference charger.

Conventionally, around the photoreceptor, various means are provided for causing the various processes including charging, light exposure, developing, transferring, charging removing and cleaning. In addition, a copy paper feeding means is provided for feeding the copy paper into the transferring means and then a fixing device.

After a full operation of copying the first document, all the various means are stopped in view of the life times of the photoreceptor and the mechanical elements, so that they are placed in the copy ready. In response to the next copy instruction, all the means are started to be activated to copy the second document.

To stabilize the property of the photoreceptor, before starting a new copy operation, the photoreceptor is full revolved without any copying operation in a condition identical with the copying operation condition while all the means are activated. At this time, no copy paper is fed and transferred. This is called a "pre-copy process" herein. The first copy operation is carried out after the pre-copy process. This results in prolonging the copying time because the time for the pre-copy process is added to a net copy operation time. When a plurality of documents are intended to be copied, such pre-copy processes are repeated each time a new document replaces the old one. This prolongs the copying time.

SUMMARY OF THE INVENTION

Accordingly, it is an object of the present invention to provide an improved electrophotograhic copying machine for initializing and stabilizing the property of the copying machine when a new document to be copied replaces an old one.

It is another object of the present invention to provide an improved electrophotographic copying machine for shortening any loss time of initializing means for copying a new document just following the first document which has been copied.

It is a further object of the present invention to provide an improved electrophotographic copying machine for eliminating any loss time of conducting a pre-copy process for each of the second or more documents following the first document to be copied when a plurality of documents are intended to be copied.

Briefly described, in accordance with the present invention, an electrophotographic copying machine is of the type which carries out a pre-copy process in response to the actuation of a copy start switch to stabilize the property of a photoreceptor before the copying operation is started. The copying machine comprises a selection means and a timer means. Responsive to the operation of the selection means, the timer means is operated upon the termination of a previous copying operation regarding the first document to be copied for counting a time during which the pre-copy process for the second document to be copied is started following the termination of the previous copying operation. Responsive to the actuation of the copy start switch, the copying operation is promptly started without needing any loss time of conducting the pre-copy process for the following copying operation.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
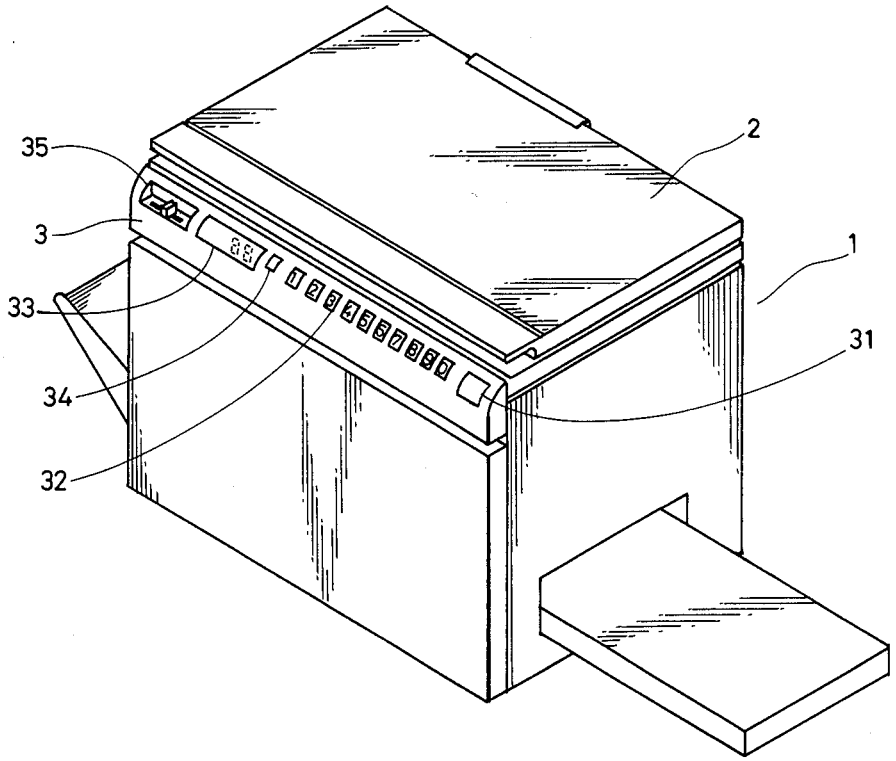
FIG. 1 is a perspective view of an electrophotographic copying machine according to the present invention.

Throughout the drawings, like elements are indicated by like reference numerals.

FIG. 1 shows a perspective view of an electrophotographic copying machine according to the present invention.

Referring to FIG. 1, the body of the copying machine comprises a document cover 2 and an operational panel 3. The operational panel 3 includes a copy switch 31, numeral keys 32 of "0" to "9", a display 33, a selection key 34, a copy density switch 35.

Figure 2:
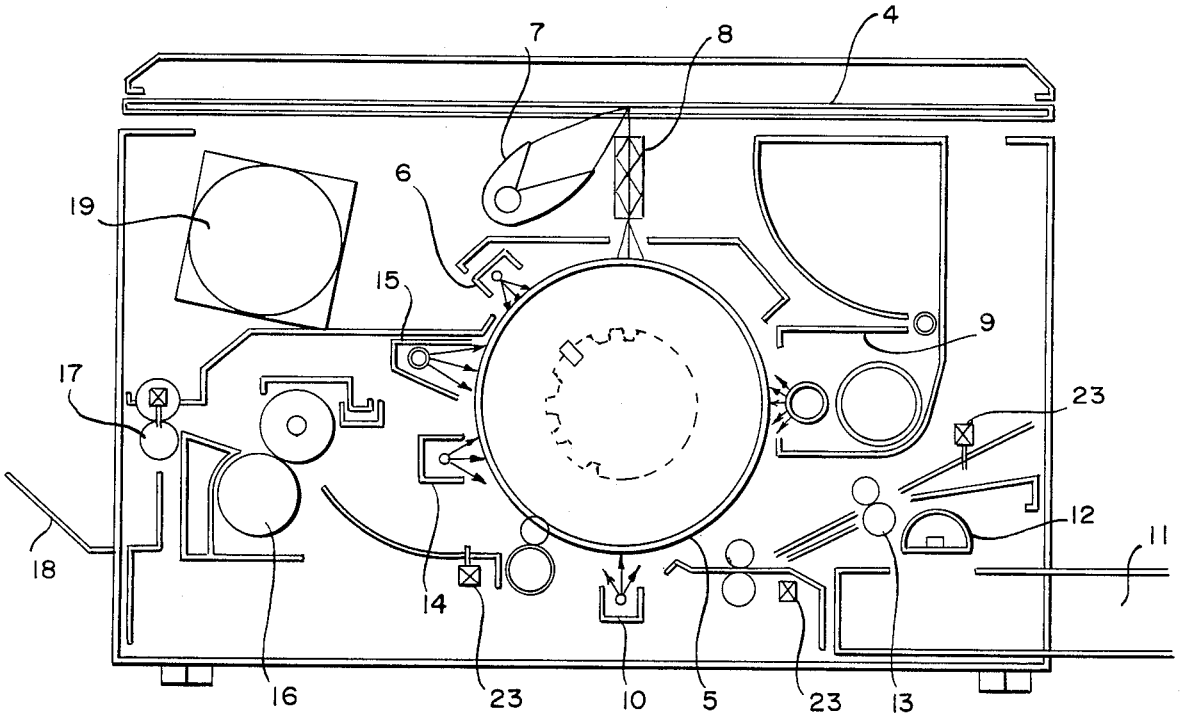
FIG. 2 shows a side view of elements that may be provided within the copying machine according to the present invention.

The copy switch 31 is operated to start the copying operation. The numeral keys 32 are operated to select the number of copy papers to be copied. The display 33 is operated to display the number of the copying papers and/or the copied papers. The copy density switch 35 is operated to control the copy image density. According to the present invention, the selection key 34 is operated to enable the pre-copy process when a new document replaces the old one. The selection key 34 is operated during the previous copying operation or, at least, just following the termination of the previous copying operation. FIG. 2 shows a side view of the copying machine of FIG. 1.

Referring to FIG. 2, a photoreceptor 5 is disposed around a rotational drum. A charger 6 is provided for charging the photoreceptor 5. A light exposing device 7 is provided for exposing light toward the document mounted onto a document table 4 as the document table 4 is reciprocated in accordance with the rotation of the drum and the photoreceptor 5, so that the reflected light beams are incident onto the photoreceptor 5 through a lens array 8 to form a latent image. A developing and cleaning device 9 is provided for devleoping the latent image with toner particles to form a toner image and, after the copy operation is carried out with rotating the drum, for cleaning the photoreceptor 5 by removing the remaining toner particles from the photoreceptor 5. A transference charger 10 is provided for transferring the toner image onto a copy paper picked up from a number of copy papers as stored within a cassette 11. Some paper pick-up rollers 12 are provided for picking up a single copy paper from the papers in the cassette 11. Some paper feeding rollers 13 are provided for feeding the picked-up copy paper into the transference charger 10. A charge removing charger 14 is provided for charging the photoreceptor 5 in a polarity opposed to the polarity of the remaining charges on the photoreceptor 5 to remove the charges from the photoreceptor 5. A lighting device 15 is provided for lighting the photoreceptor 5 to remove the charges from the photoreceptor 5. A pair of fixing rollers 16 are provided for pressing the toner image onto the copy paper to fix the toner image thereon. A pair of exhaust rollers 17 are provided for expelling the copied paper from the body 1 of the copying machine to place the copied paper onto an expel tray 18.

It is to be noted that the application of the present invention should not be limited to the copying machine of this type as shown in FIG. 2.

Figure 3:
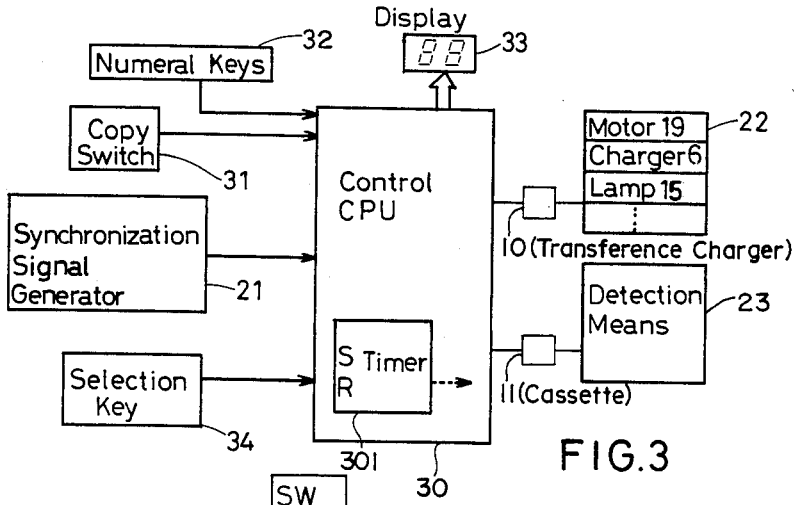
FIG. 3 is a block diagram of a circuit of the copying machine according to the present invention.

FIG. 3 shows a block diagram of a circuit implemented within the copying machine.

Referring to FIG. 3, in response to the actuation of the copy switch 31, a control central processing unit (CPU) 30 provides a motor activating signal to activate a motor 19 so that the photoreceptor 5 is revolved via a transmission means not shown. A synchrozation signal generator 21 is responsive to the rotation of the photoreceptor 5 for providing a synchronization signal representative of the rotational position of the photoreceptor 5. The synchronization signal is inputted into the control CPU 30, so that the control CPU 30 provides a control signal Io into an activation circuit 22 for activating all the various elements including the motor 19, the charger 6, the charge removing lighting device 15 and the like which are disposed around the photoreceptor 5 to thereby enable a sequential copying operation including a copy paper feeding. A detection means 23 is provided responsive to the detections of the various elements for generating a detection signal Ii into the control CPU 30, so that the control CPU 30 controls the operations of the various elements.

According to the present invention, responsive to the actuation of the selection key 34, the control CPU 30 enables a timer 301 to be started upon the termination of the previous copying operation, so that, during the time as set in the timer 301, the pre-copy process is continually carried out after the termination of the previous copying operation.

Figure 4:
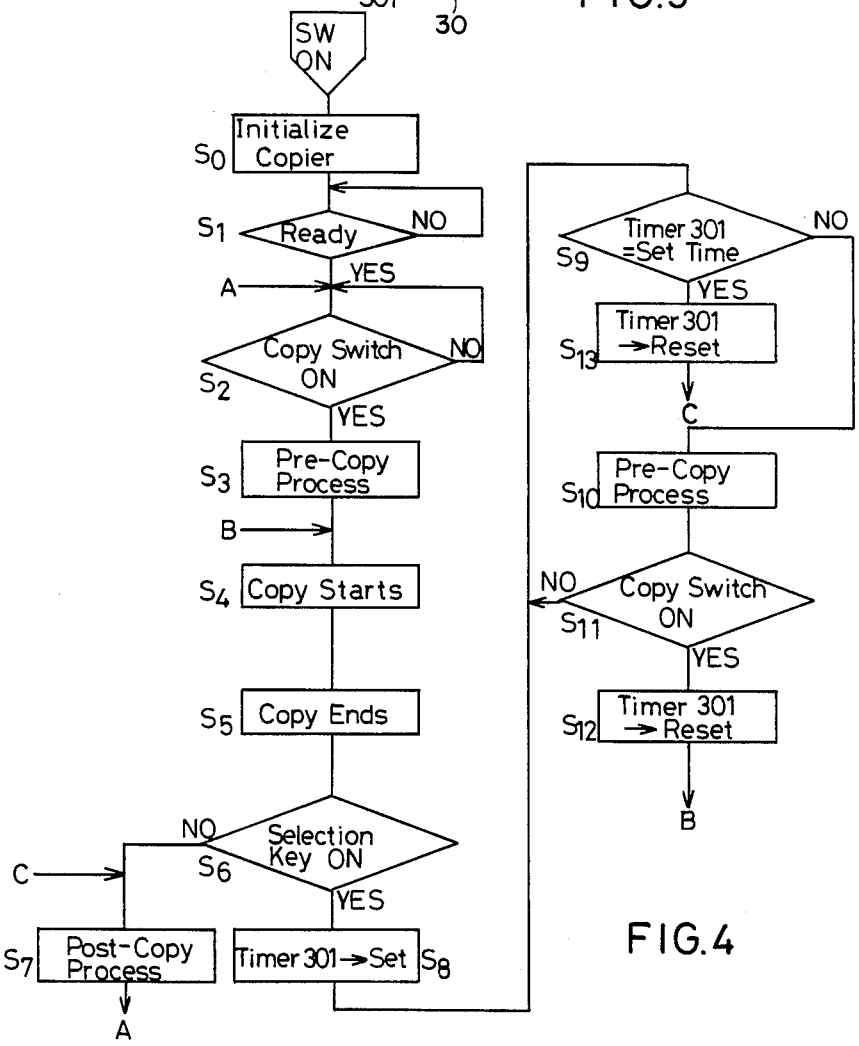
FIG. 4 is a flow chart of the operation of the copying machine according to the present invention.

FIG. 4 shows a flow chart of the operation of the copying machine, in which the following steps are conducted:

S0: After the copying machine is switched on, the control CPU 30 is initialized; thus, the photoreceptor is prepared to receive a latent image thereon.

S1: It is detected whether the copying machine is placed in its operable condition referenced as "Ready".

S3-S4-S5-S6-S7-S3: When the copying machine is placed in the ready condition, steps S3-S4-S5-S6-S7-S3 are repeated subsequently to cause the copying operation.

According to the present invention, when, in step S6 following the termination of the previous copying operation, it is detected that the operator operates the selection key 34, step S8 is selected to set the timer 301.

S9-S10: Even after the copying operation has been accomplished, the rotation of the photoreceptor 5 is prevented from being terminated, so that the pre-copy process is continued.

S11: It is detected whether the copy switch 31 is operated.

Thus, steps S9-S10-S11-S9 are repeated.

The pre-copy process is referenced as the operation that, while the photoreceptor 5 is fully revolved, all the various elements positioned around the photoreceptor 5 are activated except the feeding of any copy paper. It may be preferable that the transference charger 10 is prevented from being operated. The control signal Io from the control CPU 30 enables the pre-copy process.

While the pre-copy process is continually carried out, a new document is placed onto the document table 4 to replace the old one. During the time as set in the timer 301, the copy switch 31 is operated so that step S11 is replaced by step S12 to reset the timer 301. After the timer 301 is reset, step S4 is selected to start the new copying operation.

As described above, when a plurality of documents are to be copied, regarding the second or more documents, the pre-copy processes are not carried out in response to the operation of the copy switch 31, but, the pre-copy processes are automatically carried out in response to the termination of copying the first document. This shortens the process of copying two or more documents as short as possible, in which the time of conducting the first copying operation regarding two or more documents is substantially identical to the time of conducting each of the second or more copying operations regarding the two or more documents. Since, of course, the pre-copy process for the first copying operation regarding the first document cannot automatically be carried out, no loss time of conducting the pre-copy process for the first copying operation regarding the first document can be shortened.

Here, after the timer 301 is set, if the copy switch 31 is not operated after the time set for the timer 301, step S9 is replaced by step S7 in which the copying machine is stopped. Before step S7 is selected, step S13 is selected to reset the timer 301. After the copying machine is stopped, the copying machine is awaiting the operation of the copy switch 31.

Preferably, the time to be set in the timer 301 is selected to be a time sufficient for the time in which the operator can disposed the document onto the document table 4 with even a usual motion. It may be possible that the timer 301 is separated from the control CPU 30 in which the control CPU 30 generates a set and reset signals into the separated timer. In such a case, after the time as set for the separated timer, a signal representative of this condition is entered into the control CPU 30, so that the control CPU 30 enables all the various elements to be stopped.

Although not specifically described in FIG. 4, a flip-flop may be provided which is operated to memorize the operation of the selection key 34. This flip-flop is set in response to the operation of the selection key 34, so that the set output is inputted into the control CPU 30. This flip-flop is reset in response to a signal from the control CPU 30 generated after the time as set for the timer 301, in synchronization with the change from step S9 to S13 of resetting the timer 301. The flip-flop is not reset in step S13 of resetting the timer 301.

In the above preferred embodiment of the present invention, the selection key 34 is provided which is operated to start the pre-copy process following the termination of the copying operation. However, the selection key 34 can be neglected. In such a case, the termination of the copying operation automatically enables step S5 to be replaced by step S8 to set the timer 301 to select the repititive operations of S9-S10-S11-S9, whereby the pre-copy process is automatically carried out following the termination of the copying operation. During the time as set for the timer 301, the new document replaces the old document, so that the copy switch 31 is operated to select steps S12-S4 of carrying out the copying operation.

As described above, in accordance with the present invention, upon the termination of the previous copying operation, the timer is actuated to start the pre-copy process for the following copying operation. It is detected whether, during the time as set for the timer, a copy start instruction to start the following copying operation is inputted. Therefore, any loss time of conducting the pre-copy process can be neglected in the following copying operation. When the new document to be copied replaces the old one, the new document can be copied without any loss time of conducting the pre-copy process for this copying operation.

While only certain embodiments of the present invention have been described, it will be apparent to those skilled in the art that various changes and modifications may be made therein without departing from the sprit and scope of the present invention as claimed.

What is claimed is:

1. An electrophotographic copying machine comprising:

initialization means for preparing a photoreceptor for receiving a latent image thereon;

copying means responsive to the operation of the initialization means for copying a document;

selection means for selecting whether a second document is to be copied following a first document;

timer means responsive to said selection means for counting a time of initializing said photoreceptor by said initialization means; and a copy start switch means operated for starting to copy the second document, said copy start switch means to be operated during the full time counted by said timer means whereby said initialization means is responsive to the operation of the selection means for preparing the photoreceptor just following the copying operation of the first document to thereby copy the second document.

* * * * *